US005465100A

United States Patent [19]

Remondiere et al.

[11] Patent Number: 5,465,100

[45] Date of Patent: Nov. 7, 1995

[54] RADIATING DEVICE FOR A PLANNAR ANTENNA

[75] Inventors: Olivier Remondiere, Frouzins; Jean-François David, Toulouse, both of France

[73] Assignee: Alcatel N.V., Amsterdam, Netherlands

[21] Appl. No.: 393,526

[22] Filed: Feb. 23, 1995

Related U.S. Application Data

[63] Continuation of Ser. No. 830,404, Jan. 30, 1992, abandoned.

[30] Foreign Application Priority Data

Feb. 1, 1991 [FR] France ..... 91 01152

[51] Int. Cl.[6] ..... H01Q 13/12

[52] U.S. Cl. ..... 343/769; 343/789; 343/846

[58] Field of Search ..... 343/769, 767, 343/700 MS, 795, 789, 784, 846

[56] References Cited

U.S. PATENT DOCUMENTS

| | | | |
|---|---|---|---|
| 4,208,660 | 6/1980 | McOwen, Jr. | 343/769 |
| 4,242,685 | 12/1980 | Sanford | 343/700 MS |
| 4,724,443 | 2/1988 | Nysen | 343/700 Ms |
| 4,761,654 | 8/1988 | Zaghloul | 343/700 MS |
| 4,821,040 | 4/1989 | Johnson et al. | 343/769 |
| 4,987,421 | 1/1991 | Sunahara et al. | 343/700 MS |
| 4,994,817 | 2/1991 | Munson et al. | 343/769 |
| 5,055,852 | 10/1991 | Dusseux et al. | 343/769 |

FOREIGN PATENT DOCUMENTS

| | | |
|---|---|---|
| 0216331 | 4/1987 | European Pat. Off. . |
| 0271458 | 6/1988 | European Pat. Off. . |
| 0394931 | 10/1990 | European Pat. Off. . |
| 2627636 | 8/1989 | France . |
| 63-50202 | 3/1988 | Japan . |

OTHER PUBLICATIONS

M. Haneishi, et al., "A New Circularly Polarised Planar Antenna . . . ", Proceedings 18th European Microwave Conf., 12–15 Sep. 1988, Stockholm, pp. 1074–1079.

*Primary Examiner*—Donald Hajec
*Assistant Examiner*—Tan Ho
*Attorney, Agent, or Firm*—Robbins, Berliner & Carson

[57] ABSTRACT

A radiating device for a planar antenna, said device including a first ground plane and a second ground plane, a slot (25) provided in the first ground plane and being fed by electromagnetic coupling from a feed line (17), and an assembly of a plurality of thin conductive parts; the central portion of the radiating slot (25) being a conductive part (15) supported at its center by a supporting column (18). Application in particular to the space field.

8 Claims, 3 Drawing Sheets

RADIATING DEVICE FOR A PLANNAR ANTENNA

This is a continuation of copending application Ser. No. 07/830,404 filed on Jan. 30, 1992 now abandoned.

TECHNICAL FIELD

The invention relates to a radiating device a planar antenna and in particular for an array antenna.

BACKGROUND ART

An array antenna presents the specific feature of having an aperture made up of a large number of radiating elements; the radiation from the antenna being synthesized from the radiation of each radiating element. Such antennas are a recent development and they are currently to be found in applications to a wide variety of fields, such as:

air traffic control;

satellite reception (television, message transmission, and communication with mobiles); and space antennas: remote sensing and observation of the Earth (radars), data relays, and telecommunications antennas.

The frequencies covered range from VHF and UHF up to millimetric wave frequencies. When the radiating elements are controlled individually in amplitude and/or in phase, the antenna is said to be an active antenna. It is possible to chose the shape of the radiation pattern of the antenna, for example, so as to select widely different coverage regions (shaped beam, wide beam, or narrow beam) or so as to perform electronic scanning.

By their intrinsic radio performance level, their suitability for being put into arrays, and the technology used to make them, the radiating elements which form an antenna dictate its ultimate performance, its cost, and its technical characteristics (mass, reliability, and resistance to the environment).

Since an antenna is made up of from a few tens to a few thousands of such radiating elements, the unit cost thereof is a determining factor in the overall cost of the antenna. The same type of reasoning also applies to other parameters such as mass. The choice of technology is important because it makes it possible to simplify problems of matching the antenna to its environment. For example, for space applications in geostationary orbit, it is important to be able to control antenna temperature by simple means (thermal coverings, paints), without calling for heater power which would spoil the energy budget of the system. Under such conditions, temperature ranges as great as −150° C. to +120° C. may arise, given the thermo-optical characteristics of the surfaces. Such an antenna is further subjected to fluxes of charged particles that must neither damage the materials, nor cause electrostatic discharge after accumulating on insulating regions or on regions that are poorly grounded.

An antenna must retain all of its radio qualities even after having been subjected to high mechanical stresses during launching.

Some of these qualities, e.g. the ability to generate only very low levels of passive intermodulation products, are extremely closely linked to the technologies used (the association of the various materials, and the geometry of the elements), and to the way in which they withstand the operating environment (in particular the thermal environment).

DISCLOSURE OF INVENTION

An object of the invention is to solve these various problems.

To this end, the invention provides a radiating device for a planar antenna, said device including a first ground plane and a second ground plane, a slot provided in the first ground plane and being fed by electromagnetic coupling from a feed line, said device being characterized in that it includes an assembly of a plurality of thin conductive parts assembled together, the central portion of the radiating slot being a conductive part supported at its center by a supporting column.

In an advantageous embodiment, the device includes a body forming a cavity, which body is a machined metal part performing the various functions of a bottom ground plane for the central portion of the radiating slot and for the feed line, a mechanical structure for the device as a whole, an interface with a carrying structure for the radiating slot as a whole, and a support for the electrical interface between the feed line and the slot. The device includes a conductive cover fitted onto the body so as to constitute the top ground plane allowing propagation through the line; the line being a conductive track held between the ground planes by dielectric spacers. The device further includes a coaxial cable for feeding the line, which cable has its core soldered or welded onto the line and its outer conductor soldered or welded directly onto the body.

In another embodiment, the device may be implemented in the form of a sub-array of four identical radiating elements implemented in a single mechanical assembly; with a propagation line feeding four annular slots and including a splitter portion for 4-way splitting between the radiating elements.

Advantageously, such a radiating device has a small mass, a low cost, and remarkable radio performance. The device may be used either on its own or within an array antenna. It offers economic and technical qualities that are particularly suitable for a space application, although it is simple to convert for possible applications to other fields.

BRIEF DESCRIPTION OF DRAWINGS

The characteristics and advantages of the invention appear from the following description given by way of non-limiting example, and with reference to the accompanying drawings, in which.

BEST MODE FOR CARRYING OUT THE INVENTION

Figure 1:
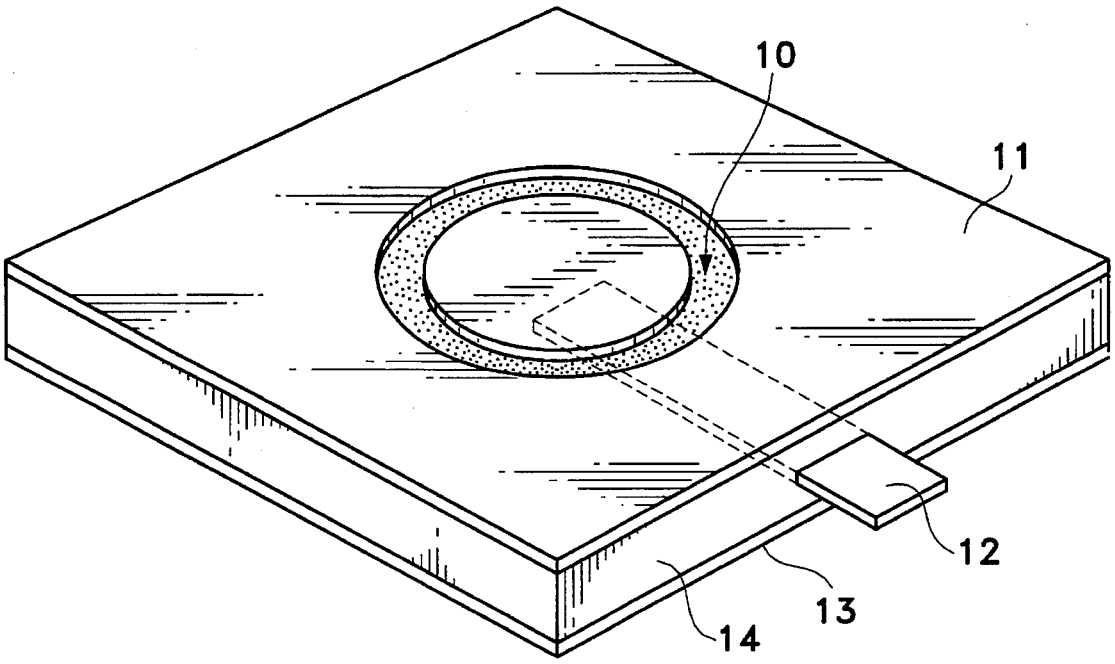
FIG. 1 (PRIOR ART)
FIG. 1 shows a prior art device.

The radiating element, as shown in FIG. 1, is commonly called an annular slot. Such an element is described in the article entitled "A new circularly polarised planar antenna fed by electromagnetical coupling and its subarray" by M. Haneishi, Y. Hakura, S. Saito, and T. Hasegawa ("18th European Microwave Conference Proceedings"; 12–15 Sep. 1988; Stockholm). In such a radiating element, a slot 10 is provided in a first ground plane 11. The slot is fed by electromagnetic coupling from a feed line 12, of the strip line type, situated at a lower level between the first ground plane 11 and a second ground plane 13. The line 12 is held in position by means of a dielectric 14.

Figure 2:
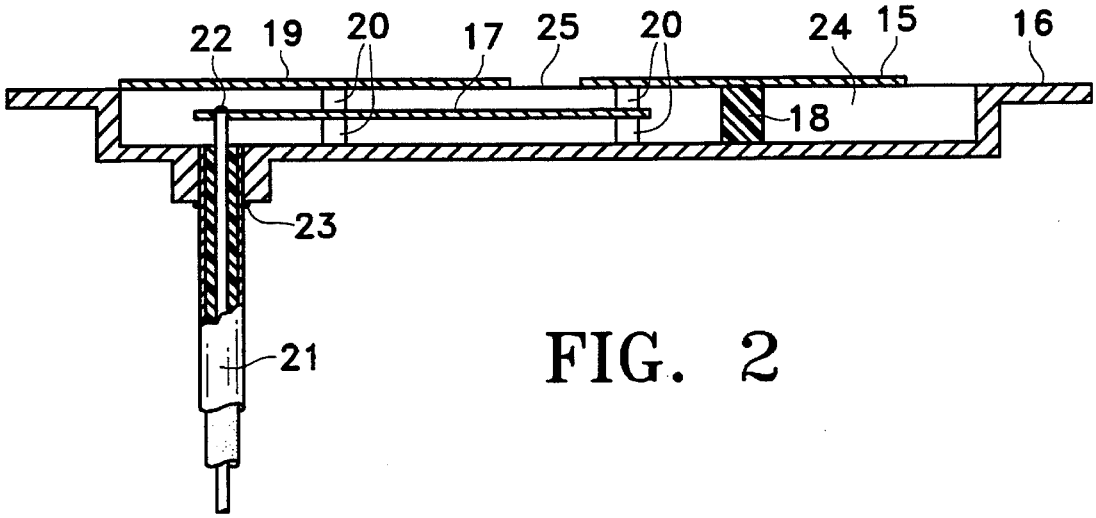
FIGS. 2 and 3 are respectively a section view and a plan view of a device of the invention.
Figure 3:
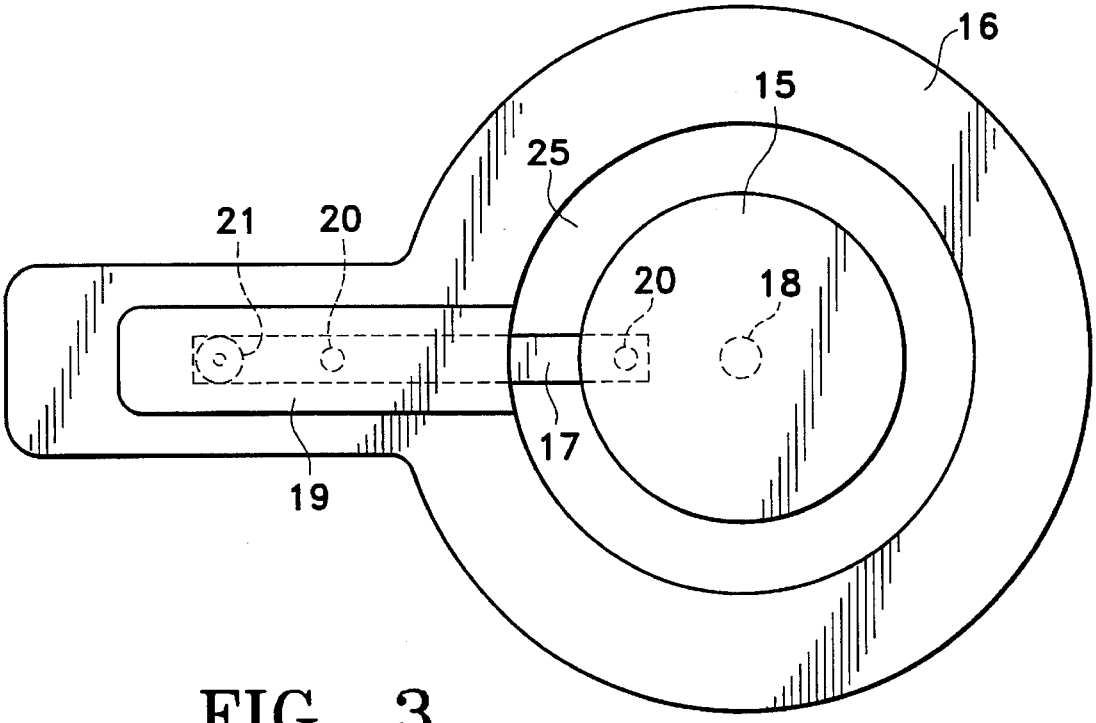

A radiating device of the invention is shown in FIGS. 2 and 3. It includes a feed line 17, a body 16 forming a cavity 24, and a radiating annular slot 25 which is provided between the body and a central disk or "patch" 15. The body 16 is a conductive part, e.g. a metal part, preferably machined from one piece, which performs the various functions of a bottom ground plane for the patch 15 and for the feed line 17, a mechanical structure for the device as a whole, an interface with a carrying structure for the radiating slot 25 as a whole, and a support for the electrical interface between the feed line and the slot 25. The patch 15 is formed of a conductive part, e.g. circular, supported by a supporting column 18. A conductive cover 19 is fitted over the body 16 to constitute the top ground plane allowing propagation through the line 17. The line 17 is a conductive track which is either monolithic or etched, and which is held between the ground planes 16 and 19 by dielectric spacers 20. For example, the line may be fed by means of a coaxial line 21.

In an application in which low generation of passive intermodulation products (PIMPs) is sought, the core 22 of the coaxial line 21 may be welded or soldered onto the line 17, whereas the outer conductor 23 is welded or soldered directly onto the body 16. This avoids one pair of coaxial connectors. Furthermore, excellent contacts are made between the various components. The components may be made from the same piece of material, or welded together (laser, electron bombardment, plasma, etc.), or soldered with a filler metal known for its good properties as regards low PIMP generation.

The radiating device as shown in FIGS. 2 and 3 may be used either on its own or else in a sub-array, with the advantageous possibility of implementing the distribution circuit of the sub-array on the same strip-line level.

The invention therefore provides a concrete technological answer which is both industrially and economically viable, and which offers excellent radio performance, in particular as regards loss, and generation of passive intermodulation products (PIMPs). It also presents good stability in the environment, by simplifying the conditions both of thermal control and of protection against radiation (electrostatic discharge phenomena).

In the device of the invention, the various conductive parts used are made of lightweight alloys, composite materials having metal matrices, or any other insulating or conductive material provided that it is metal-coated. The parts are assembled together by welding and/or soldering, and are selected for their low PIMP generation. They have very thin walls; the necessary additional stiffness or strength being supplied by local reinforcing. However, the supporting column 18 may optionally be made of a dielectric material, and the studs 20 are made of a dielectric.

Figure 4:
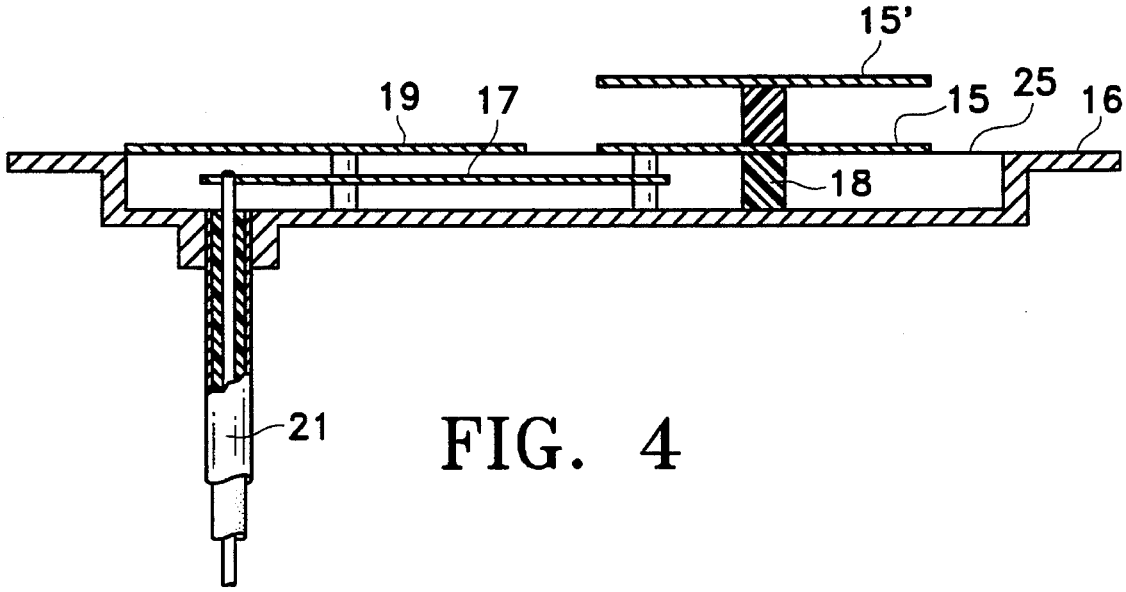
FIGS. 4 and 5 show two embodiments of a device of the invention.
Figure 5:
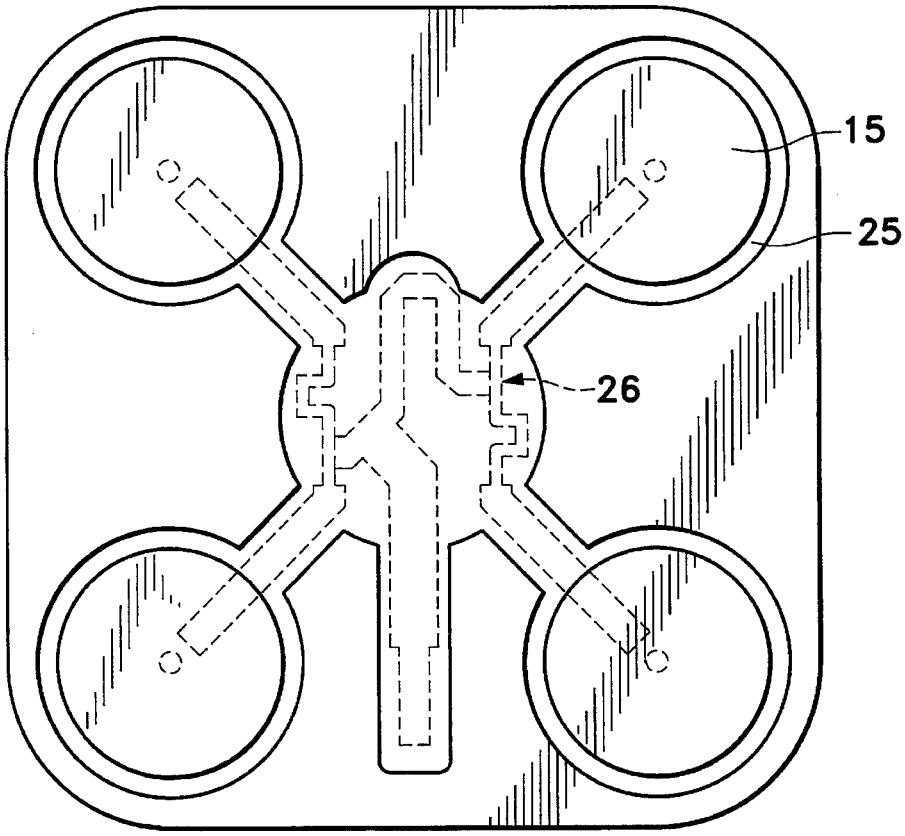

A first embodiment of the invention, as shown in FIG. 4, concerns a single device radiating in L band, and with singular circular polarization. The metal used is an aluminum alloy. The body is obtained by digitally-controlled machining which leaves walls as thin as about 0.6 mm, and local reinforcing capable of withstanding the environment of a space launch. The "patch" 15 and the cover 19 are cut out from a thin aluminum alloy sheet (e.g. about 5/10 mm). These components are fitted respectively to the supporting column 18 and to the body 16 by laser welding (with no filler metal). The track 17 is cut out from a copper alloy sheet (e.g. about 3/10 mm in thickness). The track is held between the ground planes by dielectric studs 20. The track 17 is fed via a coaxial cable 21 whose outer conductor is gold/tin soldered 23 onto the silver-coated body 16, and whose core is laser welded 22 onto the track 17 before the cover is closed. After radio optimization, it was apparent that two patch stages 15 and 15' were necessary in order to obtain the desired radio characteristics. The radiating device was subjected to random vibration in the range 20 Hz to 2,000 Hz at an integrated level of 70 $g_{rms}$ (rms=Root Mean Square), without deterioration. Its characteristics are as follows:

directivity: 9.7 dB;

loss: <0.3 dB;

axial ratio: <2 dB;

SWR: <–20 dB;

passband: 5.5%;

dimensions: thickness≈20 mm; width≈12 cm; length≈18 cm; and mass: 0.1 kg.

A second embodiment concerns a radiating device of the singular circular polarization L band sub-array type. This device comprises a sub-array of four radiating elements which are all identical to the preceding radiating element. The sub-array is implemented in a single mechanical assembly. The propagation line feeding the annular slots then includes a splitter portion 26 for 4-way splitting between the radiating elements. The implementation technology is identical in all respects to the above-described technology.

The characteristics measured were as follows:

directivity: 15 dB;

loss: <0.3 dB;

axial ratio: <2 dB;

SWR: <–20 dB;

passband: 10%;

power rating: >100 watts;

PIMP level at the 7th and 9th order under 2×40 W, between –110° C. and +110° C.: <155 dBp (dBp: dB below the peak value of the power transmitted);

dimensions: thickness≈7 mm; width≈35 cm; length≈35 cm; and mass: about 0.4 kg.

By using the characteristics of the invention, it is also possible to implement other radiating devices, such as:

a single element in C band, with single linear polarization;

a single element and a sub-array of four in Ku band, with single linear polarization; and a single element in Ku band, with double linear polarization.

Naturally, the present invention has been described only by way of preferred example, and its component parts may be replaced by equivalent parts without going beyond the ambit of the invention.

We claim:

1. A radiating device for a planar antenna, said device comprising:

a top ground plane defined at least in part in a first sheet of thin conductive material, a feed line defined in a second sheet of thin conductive material, a conductive disk surrounded by an annular slot defined at least in part in said top ground plane to thereby define an annular radiating element, said annular radiating element being fed by electromagnetic coupling from an electrical interface portion of the feed line, a conductive body comprising a thin conductive bottom wall and a thin conductive side wall projecting upwards from said conductive bottom wall to thereby define a cavity beneath said annular radiating element, said bottom wall functioning as a bottom ground plane for both the annular radiating element and for the feed line, said conductive body also functioning to provide mechanical support for the device as a whole including said top ground plane, said feed line and said conductive disk, a dielectric supporting column disposed between a central portion of said conductive disk and said conductive bottom wall, and a thin conductive cover separate from the first sheet of thin conductive material and fitted within an opening defined in the first sheet of thin conductive material above the feed line so as to constitute a portion of the top ground plane in the vicinity of the feed line, wherein the feed line is a conductive track held between the thin conductive cover and the bottom ground plane by dielectric spacers, the conductive cover is in direct mechanical and electrical contact with the first sheet of thin conductive material, and the first sheet of thin conductive material is in direct mechanical and electrical contact with the side walls of the conductive body.

2. A device according to claim 1, wherein said body supports a surrounding portion of the annular radiating element and the electrical interface portion of the feed line.

3. A device according to claim 1, further comprising a coaxial cable for feeding the feed line, said cable having a core mechanically and electrically connected to the feed line and an outer conductor mechanically and electrically connected directly onto the body.

4. A device according to any of claims 2 to 3, wherein the conductive disk is covered by at least one resonant device designed to modify the radio characteristics of said device.

5. A device according to claim 1, wherein the top ground plane, the feed line, the conductive disk, the conductive body, and the conductive cover, are each made of a material selected from the group consisting of lightweight alloys, composite materials having metal matrices, and metal-coated materials.

6. A planar antenna comprising four identical radiating elements implemented in a single mechanical assembly and each having a respective annular slot, and a common feed line feeding the four annular slots and including a splitter portion for 4-way splitting between the annular slots, wherein each of the radiating elements further comprises a top ground plane defined at least in part in a first sheet of thin conductive material, a feed line defined in a second sheet of thin conductive material, a conductive disk surrounded by a respective said annular slot, an electromagnetic coupling from a respective electrical interface portion of the feed line to said respective annular slot, a conductive body comprising a thin conductive bottom wall and a thin conductive side wall projecting upwards from said conductive bottom wall to thereby define a cavity beneath said annular slot, said bottom wall functioning as a bottom ground plane for both the annular slot and for the feed line, said conductive body also functioning to provide mechanical support for the device as a whole including said top ground plane, said feed line and said conductive disk, a dielectric supporting column disposed between a central portion of said conductive disk and said conductive bottom wall, and a thin conductive cover separate from the first sheet of thin conductive material and fitted within an opening defined in the first sheet of thin conductive material above the feed line so as to constitute a portion of the top ground plane in the vicinity of the feed line, such that the feed line is a conductive track held between the thin conductive cover and the bottom ground plane by dielectric spacers, the conductive cover is in direct mechanical and electrical contact with the first sheet of thin conductive material, and the first sheet of thin conductive material is in direct mechanical and electrical contact with the side walls of the conductive body.

7. A device according to claim 6, wherein said body supports a surrounding portion of the annular radiating element and the electrical interface portion of the feed line.

8. A device according to claim 6, further comprising a coaxial cable for feeding the feed line, said cable having a core mechanically and electrically connected to the feed line and an outer conductor mechanically and electrically connected directly to the body.

* * * * *